United States Patent [19]

Bernhardt et al.

[11] 4,274,864

[45] Jun. 23, 1981

[54] MAKING IRON POWDER

[75] Inventors: Dieter Bernhardt, Düsseldorf; Norbert Dautzenberg, Wegberg; Richard Lummer, Jüchen; Georg Huber, Monchen-Gladbach, all of Fed. Rep. of Germany

[73] Assignee: Mannesmann Aktiengesellschaft, Düsseldorf, Fed. Rep. of Germany

[21] Appl. No.: 10,146

[22] Filed: Feb. 7, 1979

[30] Foreign Application Priority Data

Feb. 14, 1978 [DE] Fed. Rep. of Germany ..... 2806716

[51] Int. Cl.[3] ..... B22F 1/04

[52] U.S. Cl. ..... 75/0.5 R; 75/0.5 C; 264/11

[58] Field of Search ..... 75/0.5 BA, 0.5 C, 0.5 R; 148/126; 264/11; 241/23

[56] References Cited

U.S. PATENT DOCUMENTS

| | | | |
|---|---|---|---|
| 3,325,277 | 6/1967 | Huseby | 148/126 |
| 3,668,024 | 6/1972 | Johnson | 148/126 |
| 3,752,712 | 8/1973 | Holcomb | 75/0.5 C |
| 3,900,309 | 8/1975 | Chao et al. | 75/0.5 C |
| 3,909,239 | 9/1975 | Findeisen et al. | 75/0.5 BA |
| 3,954,461 | 5/1976 | Chao et al. | 148/126 |
| 4,124,377 | 11/1978 | Larson | 75/0.5 C |

FOREIGN PATENT DOCUMENTS

| | | | |
|---|---|---|---|
| 572148 | 3/1959 | United Kingdom | 75/0.5 C |

*Primary Examiner*—Michael L. Lewis

*Attorney, Agent, or Firm*—Smyth, Pavitt, Siegemund & Martella

[57] ABSTRACT

Iron powder of high compressibility and low bulk density is made by atomizing a stream of molten steel by means of a conical jet of water at a rate in excess of 10 cubic meters water per metric ton of steel, the half cone angle is between 40° and 60°, preferably 45°; and air suction is provided in a region upstream from the cone, adjacent to the stream at a pressure of 0.02 to 0.20 bars below ambient, by means of a length adjustable tube extending down from the nozzle chamber. The powder is reduced at 1,000° C. to 1,200° C., and the resulting cake is broken up to obtain a powder having a particle size distribution with a higher content of larger particles than the powder immediately resulting from the atomization.

6 Claims, 1 Drawing Figure

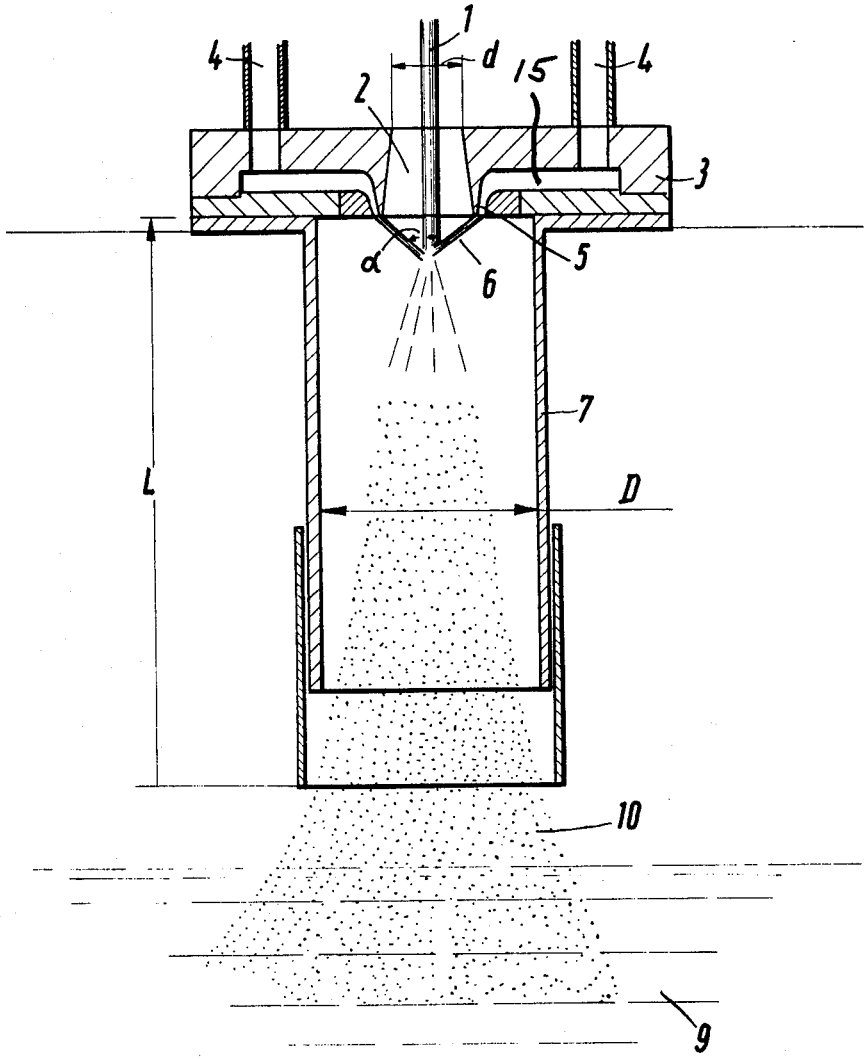
1
d
15
4
4
2
3
α
6
5
7
L
D
10
9

MAKING IRON POWDER

BACKGROUND OF THE INVENTION

The present invention relates to the making of iron powder and more particularly the invention relates to a method and equipment for atomizing molten iron by means of a water jet ejected from an anular nozzle. The invention relates further to powder made by means of such a method and such equipment and being characterized by a high degree of compressibility or compactability and low bulk density to be particularly usable for powder press working.

Generally speaking iron powder which is used in powder metallurgy and worked by means of powder presses can be classified as follows:

(a) light powder having a bulk or apparent density of about 2.5 grams per cubic centimeter and being normally compressible for compacting in that, for example, six metric tons per square centimeter increases the density to 6.8 grams per cubic centimeter;

(b) heavy powder having a bulk or apparent density in excess of 3.0 grams per cubic centimeter and a high compressibility in that, for example, six metric tons per square centimeter increases the density to 7.1 grams per cubic centimeter.

Powder as per class (a) above results from directly reducing iron ore or by atomizing highly carbonized molten iron by means of pressurized air. Upon directly reducing iron ore rather spongy materials are produced. Air atomization followed by annealing results in more or less hollow spherical powder particles.

Power as per class (b) is produced by atomizing low carburized steel by means of pressurized water. The powder particles are quite compact by themselves and they are more or less spattered depending, for example, on the water pressure. This method is described, for example, in U.S. Pat. Nos. 2,892,215 and 3,325,277.

As stated, light weight powder is characterized by medium compressibility and by a high green strength of the products resulting from compacting the powder by and in a press into particularly shaped articles. The heavy powder grades exhibit a higher compressibility, but the resulting products have an unsatisfactory green strength, particularly for lower compacting densities such as below 6.5 grams per cubic centimeter.

DESCRIPTION OF THE INVENTION

It is an object of the present invention to provide iron powder which combines high compressibility with high green strength of the product made upon pressing the powder into articles and parts.

In accordance with the present invention it is suggested to atomize a stream of molten metal by means of a conical sheet of water ejected from an anular nozzle at a pressure in excess of 80 bars at a water throughput of about 10 cubic meters per metric ton of steel; the jet sheet impinges upon a stream of molten metal (flowing in the cone axis) at an angle between 40 degrees and 60 degrees while in the region of the inside of the anulus through which the molten steel passes, the pressure is reduced for obtaining air suction at a pressure within a range from 0.02 to 0.2 bars below ambient. This suction is preferably produced by means of a tube which extends down from the anular nozzle producing the cone. Subsequently the resulting powder is annealed in a reducing atmosphere at about 1000 degree to 1200 degree C. followed by breaking up the resulting cake but into a powder having a coarser particle distribution than the distribution in particle size resulting immediately from the atomization.

It should be observed that the chosen geometry for the atomization, particularly the rather shallow cone would produce problems in that the water would tend to blow the steel particles upwardly; this will be particularly true in case of a steel throughput above 5 metric tons per hour. Moreover, the particles as produced will sputter and will be sprayed in all directions resulting in irregular cooling. This is particularly true at the high pressure by means of which the atomizing water is forced against the molten metal. These problems, however, are offset by the enhanced suction. Not only does the suction prevent an irregular backflow and upflow of the molten metal to thereby prevent clogging of the nozzle, but the suction ensures a quite orderly downflow of the steel droplets to obtain a more regular and uniform cooling and onset of solidification. The resulting powder is of a very fine consistency which in turn permits better control of the degree of fineness and coarseness of the final powder made subsequent to the annealing.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

The FIGURE illustrates somewhat schematically an atomizing device in accordance with the preferred embodiment of the invention.

The atomizing device as shown includes an annular nozzle No. 3 having a central opening through which pours a stream of molten metal having a more or less uniform diameter as discharged from a ladle, tundish or the like. The nozzle member 3 has an annular nozzle size fed by a nozzle chamber No. 15 to which in turn conduits for are connected for feeding pressurized water to the chamber 15 for discharge through nozzle 5. The pressure of the water as fed to the water chamber 15 is to be in excess of 80 bars (i.e. more than about 1100 psi) for a water throughput in excess of 10 cubic meters of water per metric ton of steel.

Reference numeral 6 denotes a conical sheet of water as ejected by nozzle 5. The cone is oriented symmetrically to a vertical axis and half of the cone angle is denoted by reference character alpha. That angle alpha is to be in the range from 40 to 60 degrees and is equal to the angle between the surface of the stream of molten metal and the (average) angle of the conical water sheet as impinging upon the stream of molten steel.

A suction tube 7 is concentrically affixed to the bottom of annular member 3, the tube being of telescopic construction to vary the length thereof. Tube 7 is provided with a flange for being removably attached to the bottom of nozzle member 3. The stream of molten metal 1 is atomized inside of the tube 7 resulting in droplets and powder particles 10 which fall into a bath 9 of a cooling medium such as water. The bath level is below the exit opening of tube 7. The nozzle member 3 (opening 2) in conjunction with the water jet and the tube 7 function additionally as a sucking device for air, and the amount of air being sucked depends on the pressure P of the water as ejected. Without tube 7 the amount of air being sucked is approximately proportional to the square root of that pressure P. The resulting suction effect is quite low. Moreover, due to the large angle Alpha, the high water pressure and the throughput of metal, the molten metal is at least in part thrown toward the nozzle which will clog very rapidly. However, upon providing tube 7 one restricts the immediate space surrounding the water cone 6, and that feature in turn increases the suction of air through the opening 2, and the metal will not be thrown back.

The suction produced by the tube 7 depends on the dimensions thereof. Increasing the length L of the tube and/or reducing the diameter D thereof will cause this suction to increase. One can say that at least approximately suction at nozzle 2 is proportional to L/D, other parameters such as the diameter of opening 2, the cone angle and the water pressure being constant.

One can now see the reason for telescoping the tube 7. In practice the operating parameter such as the diameter of stream 1, the water pressure, the angle Alpha (being the angle between the water jet and the stream of metal) establish a particular operating state including suction. The tube 7 of the given diameter D is now extended to the point that metal is not thrown back. The diameter D of the tube is preferably about equal to 1.5 of the diameter d of opening 2. It was found that indeed one can also fully avoid sputtering of metal against the walls of tube 7. Moreover the metal droplets formed on impact with the water fall down in irregular flow.

The powder as accumulated in the cooling bath is removed therefrom and annealed in a reducing non-carburizing gas such as hydrogen or a mixture of hydrogen and nitrogen and at a temperature between 1000 degrees and 1200 degrees C. Annealing at a temperature of about 1100 degrees C. results in a reduction of the oxide skin on the particles which was produced on contact with the atomizing water. Furthermore, these primary particles are being sintered during annealing. Subsequently the resulting cake is broken up to obtain a true powder whereby it is particularly important that the breaking up produces a somewhat coarser particle distribution than the original size distribution directly following atomization.

The particles as made in that manner establish a powder which combines low bulk or apparent density with high compressibility for compacting, and the green strength of the parts made from such a powder by compacting it in a press is quite high. However, these properties will be observed only if the reduction occurs in an atmosphere of less than 0.15% of oxygen and for a carbon content of less than 0.02%.

The following example illustrates the inventive method further. A particular steel was used as raw material having the following composition: less than 0.5% C; less than 0.015% each of P and S; less than 0.04% each of Cu, Cr and Ni; about 0.05% Si and 0.15% Mn, the remainder (actually more than 99%) being iron, all percentages by weight. This steel was melted and poured at a temperature of 1,600 degrees C.; the stream (1) had a diameter of 18 millimeter as it passed through the opening 2 of nozzle member 3 whose diameter d was 95 millimeters. Water, at a pressure of 85 bars was ejected by nozzle 5 at a rate of 260 cubic meter per hour. The nozzle 5 was oriented so that the half cone angle Alpha was 45 degrees. The same angle exists locally between the water jet and the surface of the stream 1.

The tube 7 had a diameter D of 150 millimeter and its length L was adjusted to one meter. As a consequence air was sucked at a quantity and at a rate approximately equal to one cubic meter per second. The resulting raw powder contained about 1.2% oxygen (as oxide skin) and had a bulk density of 3.2 grams per cubic centimeter. The particle distribution was as follows:

| | |
|---|---|
| +200 μm | 0% |
| +160 μm | 3% |
| +100 μm | 17% |
| + 60 μm | 23% |
| − 60 μm | 57% |

The powder was subsequently annealed in pure hydrogen at 1,100 degrees C. for an hour resulting in a reduction of the oxide and carbon of the particles. The cake was broken up thereafter to obtain the final powder. This powder had a carbon content of about 0.01% which is less than the carbon content in the raw steel, and the oxygen content was reduced again to 0.12%. The bulk density was lowered by the reduction to 2.5 grams per cubic centimeter. The particle distribution was as follows:

| | |
|---|---|
| +300 μm | 0% |
| +200 μm | 5% |
| +160 μm | 20% |
| +100 μm | 30% |
| + 63 μm | 25% |
| − 63 μm | 20% |

One can readily see that the raw powder following atomization but prior to annealing was finer than the final product. The final powder could be pressed and compacted into parts and articles by means of pressures being conventionally in the range from 200 to 800 $MN/m^2$ to cover a density range from about 6.0 to 7.1 grams per cubic centimeter. The green strength was excellent; particularly the specific pressure for compressing the powder into parts of comparable green strengths or much smaller.

The invention is not limited to the embodiments described above but all changes and modifications thereof not constituting departures from the spirit and scope of the invention are intended to be included.

We claim:

1. Method of making an iron powder of high compressibility and low bulk density by means of atomizing a stream of molten steel, comprising the steps of:

providing a conical jet of water at a water pressure prior to jet formation in excess of 80 bars and at a rate in excess of 10 cubic meters water per metric ton of steel, the cone of the jet having an angle so that the water impinges upon the stream at an angle between 40° and 60°;

providing air suction in a region upstream from the cone, adjacent to the stream at a pressure of 0.02 to 0.20 bars below ambient;

annealing the powder in a reducing atmosphere at a temperature from 1,000° C. to 1,200° C.; and breaking a resulting cake to obtain a powder having a particle size distribution with a higher content of larger particles than the powder immediately resulting from the atomization.

2. Method as in claim 1 said angle being 45°.

3. Method as in claim 1 or 2 said reducing temperature being 1,100° C.

4. Method as in claim 1 the breaking of the cake being carried out to obtain a powder having a particle size distribution as follows:

| | |
|---|---|
| +300 μm | 0% |
| +200 μm | 5% |

-continued

| | |
|---|---|
| +160 μm | 20% |
| +100 μm | 30% |
| + 63 μm | 25% |
| − 63 μm | 20% |

5. The method as in claim 1, wherein the step of providing air suction includes the step of running the stream through a tube, establishing an air suction path.

6. The method as in claim 5 and including the step of varying the length of the tube.

* * * * *